US005416980A

United States Patent [19]

Ilvespää

[11] Patent Number: 5,416,980

[45] Date of Patent: May 23, 1995

[54] METHOD AND APPARATUS FOR REDUCTION OF CURLING OF PAPER IN THE DRYING SECTION OF A PAPER MACHINE

[75] Inventor: Heikki Ilvespää, Jyväskylä, Finland

[73] Assignee: Valmet Paper Machinery, Inc., Helsinki, Finland

[21] Appl. No.: 808,161

[22] Filed: Dec. 13, 1991

[30] Foreign Application Priority Data

Dec. 17, 1990 [FI] Finland ..... 906216

[51] Int. Cl.[6] ..... F26B 11/02

[52] U.S. Cl. ..... 34/117; 34/116; 34/120

[58] Field of Search ..... 34/116, 117, 121, 115, 34/120

[56] References Cited

U.S. PATENT DOCUMENTS

| | | | |
|---|---|---|---|
| 2,091,805 | 8/1937 | Chose | 162/207 |
| 4,249,992 | 2/1981 | Wells | 162/207 X |
| 4,378,639 | 4/1983 | Walker | 162/207 X |
| 4,662,398 | 5/1987 | Wywailowski et al. | 162/207 X |
| 4,876,803 | 10/1989 | Wedel | 34/117 |
| 5,175,945 | 1/1993 | Skaugen et al. | 34/117 |

FOREIGN PATENT DOCUMENTS

| | | |
|---|---|---|
| 793920 | 9/1985 | Finland . |
| 85524 | 12/1991 | Finland . |
| 1183775 | 12/1964 | Germany . |
| 3023536 | 4/1981 | Germany . |
| 8503094 | 7/1985 | WIPO . |
| 8704740 | 8/1987 | WIPO . |

*Primary Examiner*—Denise L. Gromada

*Attorney, Agent, or Firm*—Steinberg, Raskin & Davidson

[57] ABSTRACT

The invention is related to a method and a device in the drying section of a paper machine for reducing the tendency of the paper to curl. The paper web is dried on drying cylinders, against whose heated faces the paper web is pressed by means of a drying wire. In the drying section, groups of drying cylinders are used, in which twin-wire draw and/or single-wire draw is/are applied. In the drying section, hot water steam is fed substantially onto the entire width of the paper web, by means of which steam tensions that have been formed or that tend to be formed in the fiber mesh in the paper web are relaxed by means of heat and moisture in the area of their formation or substantially immediately thereafter. Moreover, the transverse curling profile and/or moisture profile of the paper web can be controlled by the steam treatment.

25 Claims, 5 Drawing Sheets

METHOD AND APPARATUS FOR REDUCTION OF CURLING OF PAPER IN THE DRYING SECTION OF A PAPER MACHINE

FIELD OF THE INVENTION

The present invention is related to a method in the drying section of a paper machine, in particular for reduction of a tendency of paper curling. In this method, the paper web is dried on drying cylinders, against whose heated faces the paper web is pressed by means of a drying wire, and in which drying section groups of drying cylinders are used in which twin-wire draw and/or single-wire draw is/are applied.

The present invention is also related to a drying section of a paper machine intended for carrying out the method of the invention. The drying section comprises one, or preferably several subsequent drying groups, which comprise drying cylinders and wire guide rolls and/or leading cylinders, and in which drying section single-wire draw and/or twin-wire draw is/are applied.

BACKGROUND OF THE INVENTION

As is known in the prior art, in the drying section of a paper machine, single-wire draw and/or twin-wire draw is/are applied.

Single-wire draw, in which the drying wire also supports the web on the draws between the rows of cylinders, is usually employed in the initial part of the drying section. Single-wire draw may also be used over the entire length of the drying section.

Recently, drying sections provided with single-wire draw have become common in which the upper or lower cylinders are steam-heated drying cylinders against which the web is placed in direct contact pressed by the drying wire, and in which the lower or upper cylinders are cylinders provided with internal suction, for example the assignee's so-called "VAC-ROLL TM" cylinders. In "VAC-ROLL TM" cylinders, the effect of negative pressure is applied through the perforated mantle from the interior of the leading cylinder to the grooves passing around the cylinder mantle. By means of the effect of negative pressure, the web is kept in contact with the drying wire when the web is placed at the side of the outside curve on the leading cylinders. At the same time, attempts are made to prevent transverse shrinkage of the web as the drying makes progress.

Typically, in a multi-cylinder dryer, there are 5 to 8 wire groups. The groups placed in the initial end of the drying section are normally shorter than the groups placed in the final end.

With regard to prior art related to the present invention, reference is made to FI Pat. Appl. 793,920; FI Published Patent Application 70,277; and to DE Patent 1,183,775. In these publications, various devices for profiling of the moisture content in a paper web are described. These devices are, however, not employed for the control of anisotropy in the direction of thickness of paper nor for the control of the tendency of curling.

As is well-known, the lateral portions of a paper web become dryer than the middle portion of the web in the drying section of a paper machine. This flaw of moisture profile is commonly corrected after said principal drying stage either by drying the middle area additionally by means of infrared radiators divided in zones or by moistening the edges by means of water sprayed in zones. Both of these prior-art modes increase the relative slackness of the edges in relation to the middle portion.

The tension profiles of paper in the transverse direction and in the thickness direction depend on the moisture profiles of the paper. On the other hand, the tension of paper on drying has an effect on the properties of the paper. When the moisture profile of paper is affected, e.g., during drying, the properties of the paper are also altered at the same time. The properties of paper, for example tensile strength, are developed extensively at a dry solids content of about 75 to about 98%. Thus, the tension profiles, expressly at the final stage of the drying, have a great importance in view of the ultimate properties of the paper.

When a paper machine dries the web unevenly in its transverse direction, this causes, among other things, uneven tension in the web. An uneven tension profile means, for example, that the edge of the paper web produced by the paper machine has more slack than the middle portion of the web. This is a common occurrence in presently available paper machines. By means of measurements, it has been found that, in the transverse profile of tension, peaks and valleys, i.e. tighter and slacker zones, also occur in the middle portions of the web.

In the stages of web treatment after the paper machines, unevenness of the tension profile in the web may produce remarkable handling and running problems, e.g., in the control of the structure of the reel for the customer, in formation of wrinkles, as breaks, and as problems of alignment in a printing machine.

The slack edge of a paper web can be explained by means of three well-known factors. First, in a conventional cylinder drying group, the edges of the web dry more quickly than the middle of the web. Second, the water-swollen fibers and the paper web shrink when the drying makes progress. This shrinkage is particularly intensive in the range of dry solids content of about 65 to about 95%. Third, the deformation of paper when moist is primarily plastic, whereas the force-elongation behavior of a paper of higher dryness is largely elastic. Thus, a deformation produced in moist paper, such as stretching, mostly remains permanent, whereas a stretching in a paper of higher dryness is largely restored, being lost when the force is gone.

Curling of paper is one of its negative quality factors. Reducing the tendency of curling of paper, in particular of fine paper, has become more and more important along with new printing and copying methods, in which the paper is heated suddenly, as a rule from one side, so that any internal strains that may have remained in the paper because of different reasons are discharged in the form its curling. The tendency of curling of paper is affected both by the anisotropies in the different properties of the structure of the paper, such as fiber orientation, filler distribution, and density, and by anisotropies produced in the paper during drying, both in the direction of the plane of the paper and in the z-direction (i.e., the direction of thickness).

It is a drawback of the drying groups with single-wire draw described above that they do not dry the paper symmetrically, but the drying effect is applied more extensively to the face of the paper that reaches direct contact with the heated drying cylinders. Owing to this asymmetric drying, recently such drying groups with single-wire draw have been introduced in which certain groups, for example, every second group, are so-called inverted groups, in which the steam-heated drying cylinders are in the lower row and the leading cylinders are in the upper row. However, in the inverted groups, difficulties occur in the removal of broke, because the free sectors of the drying cylinders are not opened downwards, as they are in normal groups, but they form pockets that are closed at the bottom. In the inverted groups, problems are also caused by the ventilation of the spaces that remain in the gaps between the leading cylinders as well as by the differences in pressure in the narrowing wedge spaces placed in connection with the free faces of drying cylinders in relation to the environments of said wedge spaces.

One factor that has a substantial effect on the curling of paper is one-sided drying of the paper. In drying sections provided with the traditional twin-wire draw, the web can be dried at the same rate from both sides. Thereby, the uniformity of drying can be affected, and the tendency of curling of paper can be prevented, by regulating the steam pressures in the upper and lower cylinders.

By means of the new concept of a dryer with single-wire draw, said drying at the same rate and said possibility of regulation cannot be accomplished. Attempts are made to prevent unequal drying on either side of the paper by means of the inverted drying groups, in which the above problems of cleaning, however, deteriorate the running quality of the paper machine.

In connection with calendaring, it is known in the prior art to employ steam spraying applied to the paper. The effect of steam spraying is based on relaxing the strains in the paper fibers by the effect of heat and moisture. However, in the calendaring stage, it is no longer possible to sufficiently eliminate the tendencies of curling of paper in all cases in an efficient manner.

OBJECTS AND SUMMARY OF THE INVENTION

It is an object of the present invention to provide novel solutions for the problems discussed above.

It is a particular object of the invention to provide a method for paper manufacture and a drying section for a paper machine by whose means it is possible to manufacture a paper of higher dimensional stability more favorably than in the prior art.

It is a further object of the invention to provide a method and a drying section of a paper machine in which it is also possible to perform profiling of the paper in the machine direction and in the transverse direction more favorably than in prior art.

In additional embodiments, it is a further object of the invention to provide a method that contributes to the provision of a single-wire draw drying section in which there are no inverted wire groups, broke-handling or ventilation problems occurring in such groups. However, it should be emphasized that the present invention is applicable to inverted single-wire groups as well.

In view of achieving the objectives stated above, those that will come out later, and others, the method of the invention is comprises feeding steam substantially onto the entire width of the paper web, in the drying section of a paper machine. By virtue of this application of steam, tensions that have been formed or that tend to be forced in the fiber mesh in the paper web are relaxed by means of heat and moisture in the area of their formation or substantially immediately thereafter.

The drying section in accordance with the present invention comprises at least one steam supply box fitted in the drying section, and which extends substantially across the entire transverse width of the paper web to be steam-treated. The steam box is connected to a source of steam. The steam box comprises a counter-face, which, together with the free face of the paper web that runs at its proximity, defines a contact-free steam-treatment gap.

In the invention, the relaxation of the paper may be based on an equalization of the properties of the web so that a controlled change is performed in the properties of the paper web (in a way similar to annealing), whereby the paper is regulated to higher uniformity. In the present invention, this controlled change is accomplished by means of moisture and temperature.

By means of the invention, the "flaws" that produce the tendency of curling of paper are corrected in the area of their formation or substantially immediately thereafter, in which case the correction can be made more advantageously and more efficiently.

The invention can be favorably combined with the profiling of the paper, in particular with the control of the transverse curling profile and of the moisture profile, so that the paper can be made to run through the drying section as of substantially uniform curling and moisture profiles, in which case the drawbacks arising from uneven tensions in the web can also be avoided, as described in the assignee's afore-mentioned FI Pat. Appl. 902805.

In a particularly advantageous embodiment, the steam box employed in the invention is placed in a position in which the paper web to be steam-treated runs over a suction sector of a suction cylinder or suction roll.

By means of the water-steam treatment in accordance with the present invention, the anisotropy in the thickness direction of the web is controlled as a continuous process by producing a specified temperature and moisture level in the paper or in its surface so that adequate relaxation occurs in the paper.

BRIEF DESCRIPTION OF THE DRAWINGS

In the following, the invention will be described in detail with reference to some embodiments of the invention illustrated in the figures in the accompanying drawing, the invention being in no way strictly confined to the details of said embodiments.

DETAILED DESCRIPTION

Figure 1:
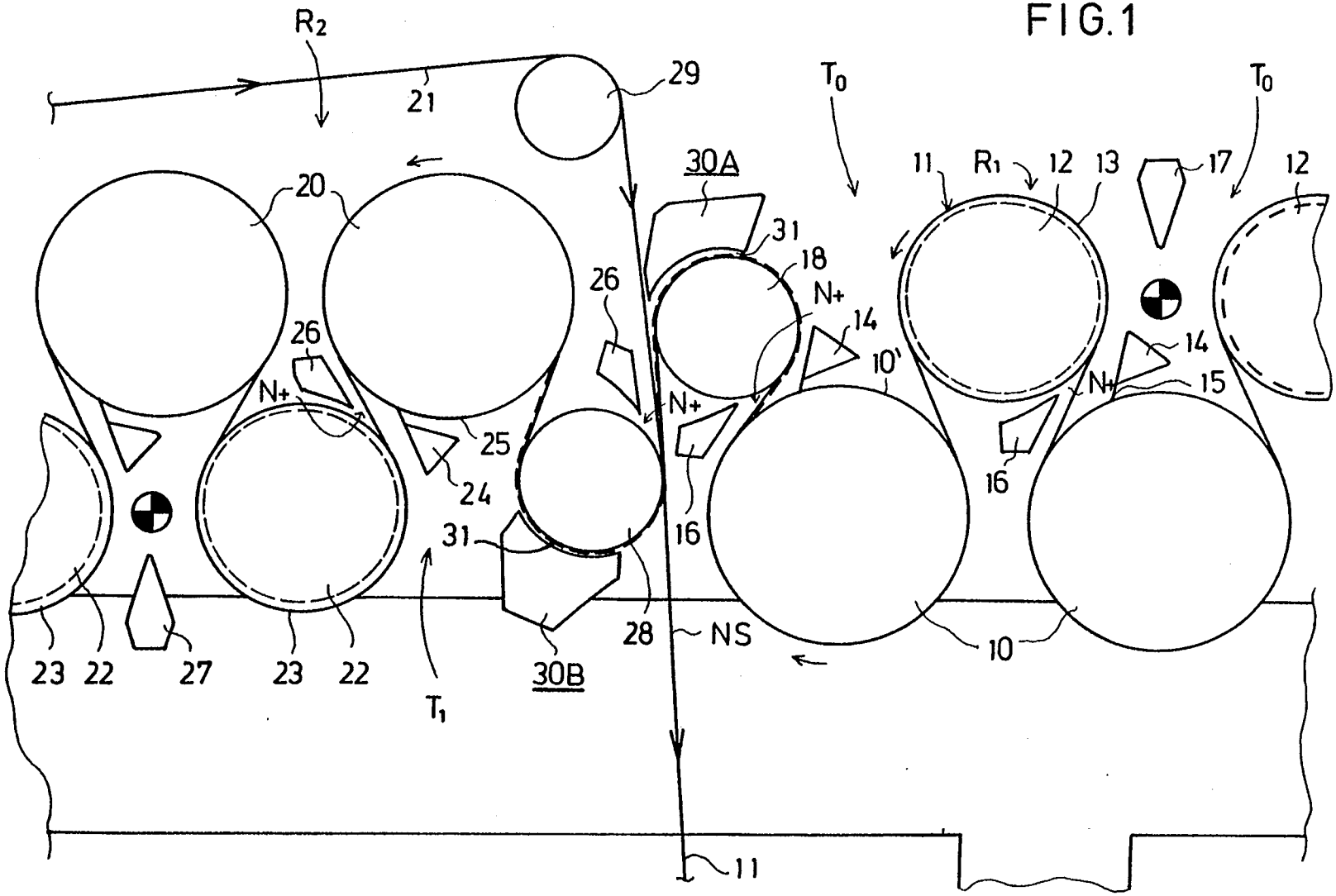
FIG. 1 is a schematic side view of a part of the drying section of a paper machine in which the method and the device in accordance with the invention are applied.

FIG. 1 illustrates the area of the gap between the drying groups $R_1$ and $R_2$ in a multicylinder dryer of a paper machine. The first group $R_1$ is a so-called inverted cylinder group, in whose intermediate spaces $T_0$, which are closed at the bottom, problems of broke handling and moisture removal occurred in prior art. The latter group $R_2$ is a so-called normal group, in which the drying cylinders 20 are placed in the upper row.

In the former group $R_1$, a drying wire 11 is employed, which runs meandering over the drying cylinder 10 and the leading cylinder 12 so that the web W reaches direct contact with the heated faces 10' of the drying cylinders 10. The drying cylinders 10 are placed in the lower row and the leading cylinders 12 in the upper row. The leading cylinders 12 are suction cylinders provided with perforated grooved mantles 13, for example cylinders marketed by the assignee under the trademark "VAC-ROLL TM".

Doctor 14 blades 15 operate against the smooth faces 10' of the drying cylinders 10. In view of ventilation of the intermediate spaces $T_0$, air is blown into said spaces out of blow pipes 17. Moreover, in the inlet nips N+, blow devices 16 are employed, by whose means induction of pressure is reduced or prevented in said nips N+. In the group gap $R_1$–$R_2$, after the guide roll 18, the web W is transferred from the wire 11, in the transfer area NS, onto the guide roll 28. In the group $R_2$, the web W to be dried is guided, on support of the drying wire 21 guided by the guide roll 29, over the drying cylinders 20 and the suction cylinders 22. In the group $R_2$, there are doctors 24 provided with blades 25 as well as blow boxes 26 and 27. Since the intermediate spaces $T_1$ underneath the cylinders 20 are opened downwards, there are no broke handling problems in a "normal" group $R_2$.

Above, a drying section in itself known has been described as a background and environment of application for the present invention.

In FIG. 1, to be used in the draw in the group gap $R_1$–$R_2$ both in connection with the guide roll 18 of the drying wire 11 in the inverted group $R_1$ and in connection with the guide roll 28 in the normal group, steam boxes 30A and 30B are shown, through whose treatment gap 31 a steam treatment in accordance with the invention, which has an adjustable transverse profile and which relaxes the strains, is applied across the entire width of the web W, which steam treatment will be described in more detail later.

Figure 2:
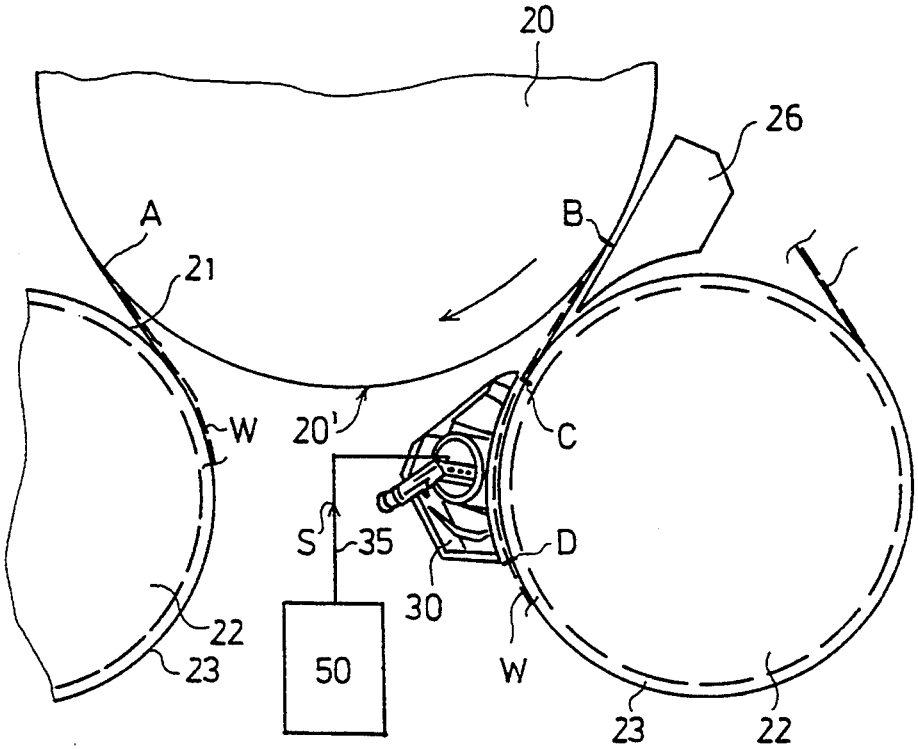
FIG. 2 shows an application of the method of the invention in single-wire draw.

FIG. 2 shows an application of a steam box 30 in accordance with the invention to single-wire draw in connection with a suction cylinder 22. In accordance with the invention, a steam box is fitted in connection with the suction cylinder, by means of which steam box a steam treatment is applied to the entire width of the web W.

By means of the heat and moisture provided by the steam treatment (compare the effect of a steam-iron), strains that tend to be formed in the web W are relaxed. At the same time, the steam box 30 can be used for the control of the transverse curling profile and moisture profile in the web W so that the web W proceeds through the whole drying section with maximally uniform profiles so that differences in tensions do not arise.

The suction cylinder 22 that is used is preferable a cylinder marketed by the assignee under the trademark "VAC-ROLL TM", whose mantle is provided with perforations, which are opened into grooves 23 that pass around the cylinder 22 mantle. A negative pressure is produced in the interior of the cylinder 22, which is spread onto the circumference of the cylinder through the perforations and grooves in the mantle. This negative pressure can, to some extent, promote the penetration of the steam treatment by the steam box 30 into the web in the direction of thickness. In FIG. 2, the block 50 is a schematic representation of steam generation means, from which a steam flow S is passed through the pipe 35 into the steam box 30.

In a preferred embodiment of the invention, a drying group is accomplished in which, as groups with single-wire draw, exclusively so-called normal groups are used, in which the heated drying cylinders, against whose faces the web W is in direct contact, are placed in the upper row, as is the case in FIG. 1 in respect of the cylinders in the group $R_2$.

Figure 3:
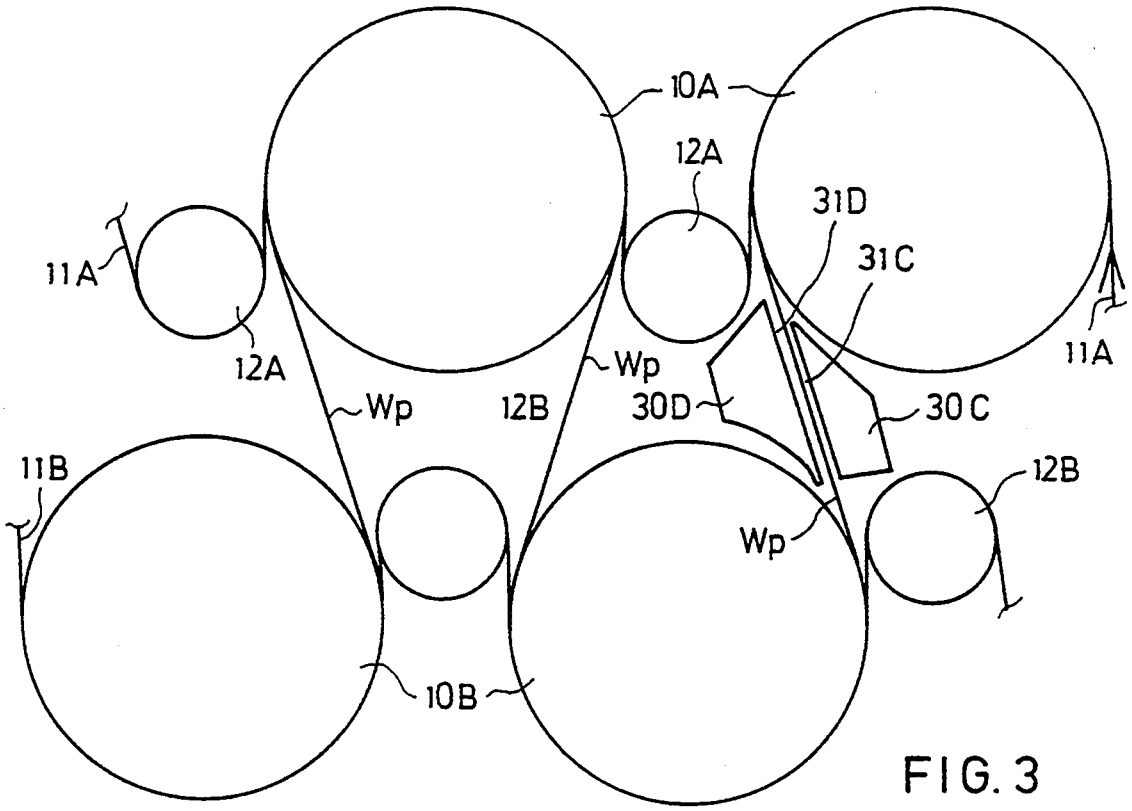
FIG. 3 shows an application of the method of the invention in twin-wire draw.

FIG. 3 shows an application of the invention to an area with twin-wire draw. As is shown in FIG. 3, the drying section comprises two rows of steam-heated drying cylinders 10A and 10B placed one row above the other as well as an upper wire 11A and a lower wire 11B. The wires 11A and 11B are guided by guide rolls 12A and 12B placed in the gaps between the cylinders 10A, 10B, so that the web W has free draws $W_p$ between the rows of cylinders. On these free draws, according to FIG. 3, two steam boxes 30C and 30D are placed, by whose means the web W is steam-treated across its entire width from both sides in accordance with the invention through the contact-free treatment gaps 31C and 31D.

Figure 4:
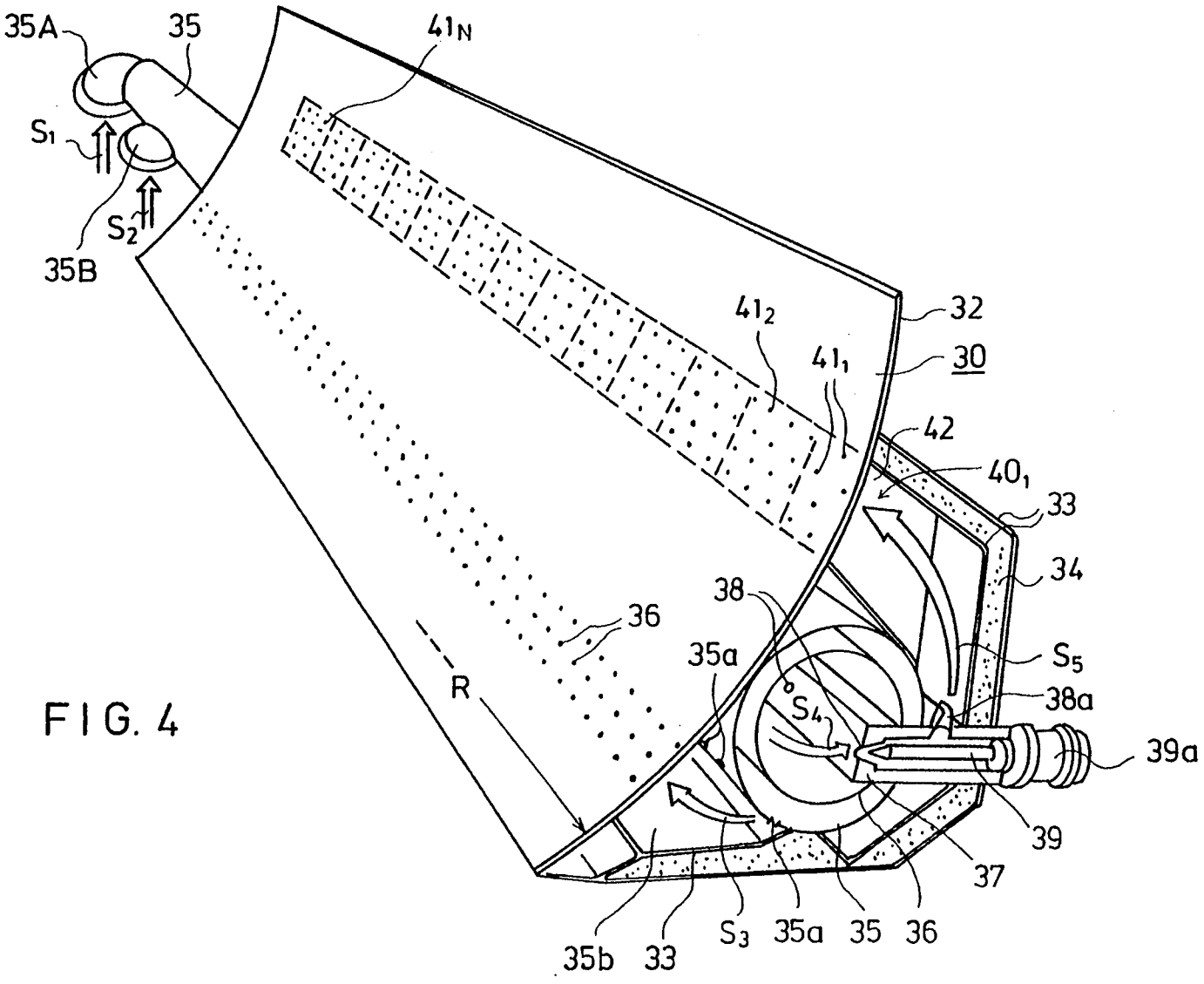
FIG. 4 is an axonometric view of a steam box that can be applied in the invention.

With reference to FIG. 4, an exemplifying embodiment of a steam box 30 applied in the invention will be described. The steam box 30 comprises a counter-plate 32, whose curve radius R corresponds to the curve radius of the cylinder 12;22 or roll 8;28 (see FIG. 1) against which steam box 30 is placed to operate. The steam box 30 is provided with a box part 33 attached to the counter-plate 32 and fitted with thermal insulation 34. Into the steam box 30, steam at a suitable temperature is introduced by the intermediate of the connections 35A and 35B through the inlet pipe 35 in the directions of the arrows $S_1$ and $S_2$. Inside the pipe 35, there is a coaxial second pipe 36, into which the connection 35B (steam $s_2$) is opened. The outer pipe 35 is provided with a series of nozzle holes **35*a*, which are opened into the space 35*b*, which extends across the entire width of the steam box 30, and the steam ($S_1$) supplied through the connection 35A is discharged in the direction of the arrows $S_3$ into the space 35*b* and, out of said space, further through the numerous nozzle holes 36 in the counter-plate 32** to act upon the web W against its free outer face.

According to FIG. 4, through the nozzle holes 36, a basic supply of steam is carried out without transverse profiling. The transverse profiling of the steam supply is carried out by means of the steam (arrow $S_2$) supplied through the inner pipe 36. In connection with the inner pipe 36, there is a regulation beam 37, which is provided with a series of nozzles 38. The nozzles are provided with regulation spindles 39, which are regulated by means of regulation screws or regulation motors **39*a*. The nozzles 38, regulation spindles 39, and regulation screws or regulation motors 39*a* act as a regulation means by which the quantity of steam supplied by the steam box is controlled by the regulation blocks $40_1 \ldots 40_N$ in the steam box. Through the nozzles 38, by the intermediate of the connection 38*a* provided in the beam 37, adjustable quantities of steam are supplied in the direction of the arrows $S_5$ through the regulation blocks $40_1 \ldots 40_N$ in the steam box. The regulation blocks 40 are separated from one another by vertical partition walls 42 placed in the machine direction. From the regulation blocks $40_1 \ldots 40_N$ the steam is fed through the series of nozzle openings $41_1 \ldots 41_N$ provided in the counter-plate 32 to act upon the adjacent web W. If necessary, the series of regulation motors 39***a* can be connected to a control system, preferably to a control system provided with a feedback arrangement, in which a series of feedback signals is received from devices (not shown) which are known in themselves and which measure property profiles of the web W, such as moisture profiles.

According to the principle of operation of the invention, by means of the steam box 30 or steam boxes, steam is fed onto the paper web W that is being dried, by means of which steam the distribution and gradients of the properties of the paper in the direction of thickness (z-direction) are affected. By means of the steam treatment, strains that arise or are about to arise in the web W can be relaxed in the area of their formation or immediately after said area, in which case the relaxation is particularly efficient. Thus, the paper can be made less susceptible of curling when it is used, e.g., in a laser copier. At the same time, by means of the method and the device in accordance with the invention, the transverse curling and moisture profiles of the web can be equalized, which provides a more even drying result in the ultimate drying as well as an improved operability of the machine, because web breaks, arising, for example, from differences in tightness, occur less frequently.

Steam boxes 30 in accordance with the invention can be placed as a necessary number along the drying section. The steam boxes in accordance with the invention are most useful when employed in the final end of the drying section.

The method and the device in accordance with the invention are particularly well suited for use in the drying section in an area in which the dry solids content ka of the web is in the range of ka =from about 70 to about 98%, most appropriately in the range of ka =from about 80 to about 95%. The invention is applied most appropriately in drying groups provided with single-wire draw even though twin-wire draw and even two-sided applications are not excluded from the scope of the invention.

By means of the invention, it is favorably possible to accomplish a drying section in which, as groups with single-wire draw, only such "normal" groups are employed in which the heated drying cylinders 20 constitute the upper row, in which case there are no ventilation or broke handling problems. Further, the invention permits a fully closed draw to be provided in a drying section, in which the drying section is, over its entire length, accomplished by means of said "normal" groups with single-wire draw. Such a drying section is particularly advantageous in paper machines of very high running speeds, in which a closed draw is particularly useful in view of the running quality of the paper machine.

Figure 5A:
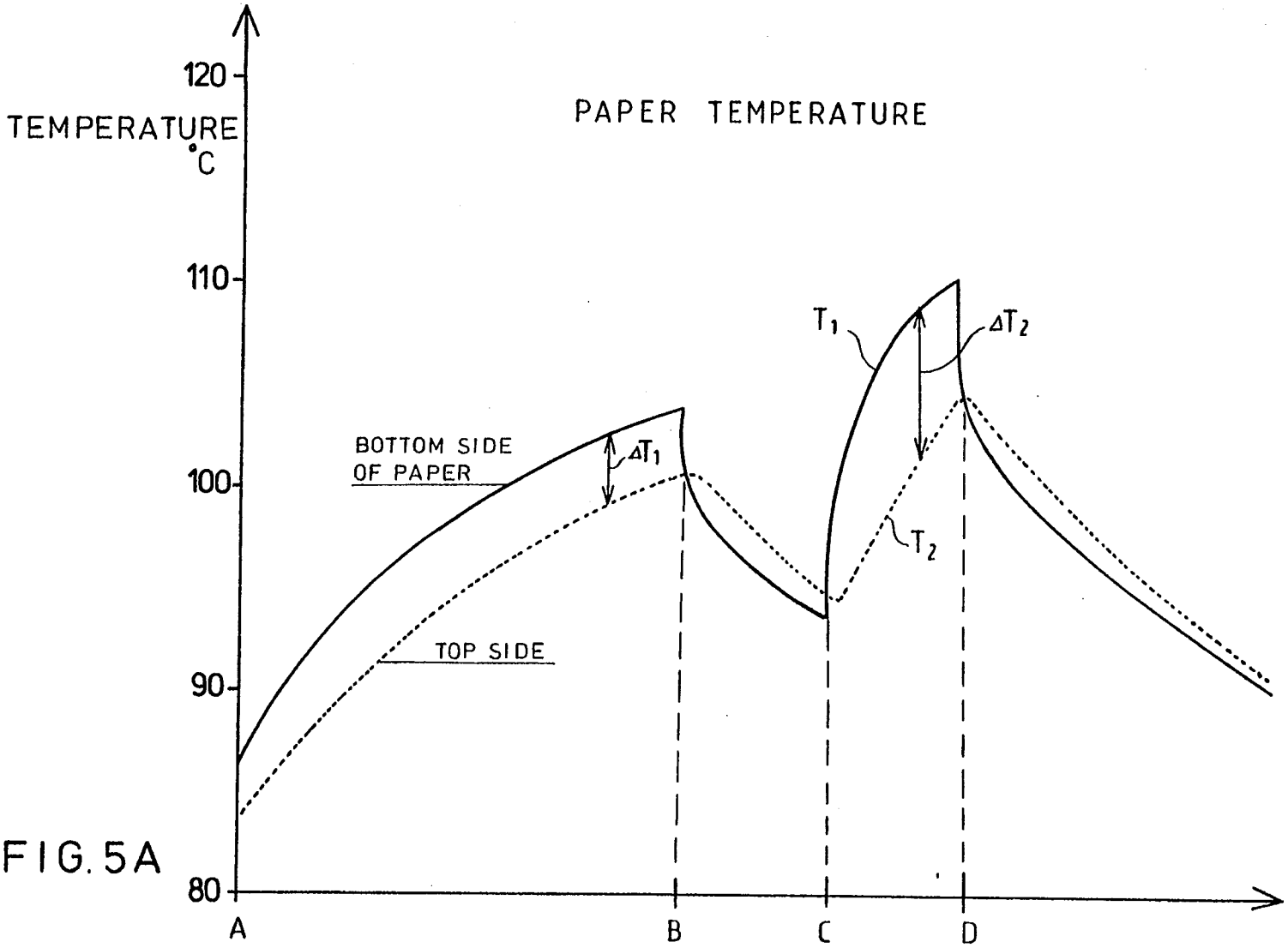
FIG. 5A is a graphic illustration of an example of the distribution of temperature on a top face and a bottom face of the paper in the areas between the points A, B, C and D, which are indicated in FIG. 2.
Figure 5B:
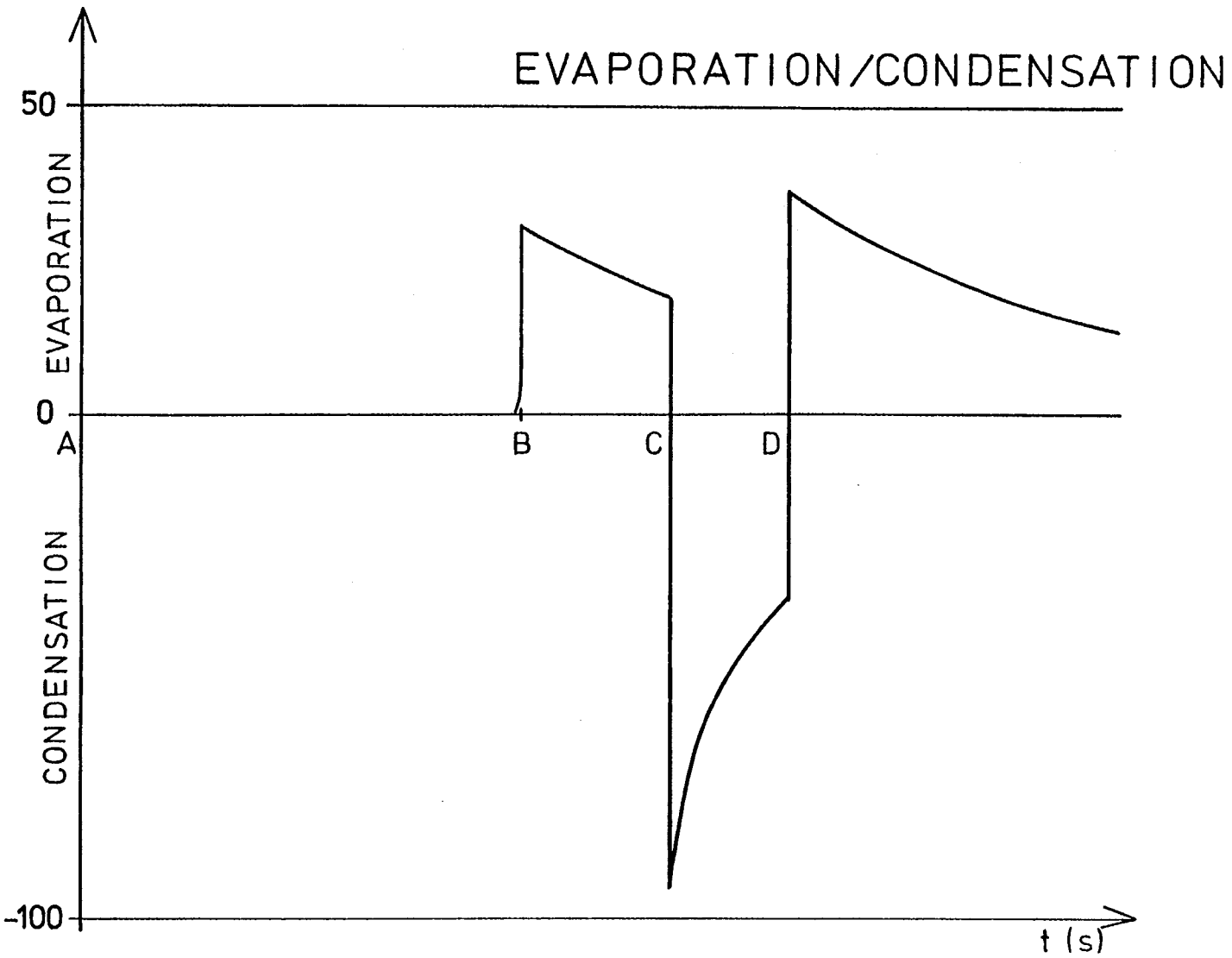
FIG. 5B is an illustration corresponding to FIG. 5A of evaporation and condensation taking place in the paper in said areas A to D.

FIGS. 5A and 5B illustrate the effect of a 110° C. steam on a 50 g/m$^2$ newsprint when the web W speed is 1500 m/min.

FIG. 5A illustrates the temperature T of the paper web W in a steam treatment as shown in FIG. 2 in the area A . . . D on the cylinders 20 and 22. The curve $T_1$ drawn with full line represents the temperature of the bottom side of the paper, i.e. of the side that is in direct contact with the face 20' of the drying cylinder 20, and the curve $T_2$ drawn with dotted line represents the temperature of the opposite side (top side). As can be seen from the graph, in the area A . . . B of the curves $T_1$ and $T_2$, the temperature at the bottom side ($T_1$) of the paper is higher than that at the top side ($T_2$), the difference in temperature being denoted with $\Delta T_1$. In the area B . . . C, where the web W is transferred from the drying cylinder 20 onto the leading cylinder 22, the temperature $T_1$ of the bottom side is lowered, because of the more intensive evaporation taking place from the free face of this side, i.e. from the face opposite in relation to the drying wire 21, more steeply than the temperature $T_2$ of the opposite face. Thus, at the point C, where the beginning of the area of effect C . . . D of the steam box 30 in accordance with the invention is reached, which area is placed facing the perforated and grooved suction face 23 of the cylinder 22, the temperature $T_1$ of the bottom side is somewhat lower than the temperature $T_2$ of the top side (point C). Hereupon, in the steam treatment are C . . . D of the box 30, the temperature $T_1$ of the bottom side (outer side) of the web W is raised very steeply, so that the difference in temperature $\Delta T_2$ is increased considerably by the time the point D is reached. Hereupon, the difference in temperature between the two faces of the web W is equalized rapidly after the point D.

FIG. 5B shows evaporation/condensation of water from the web/into the web W in a situation corresponding to FIG. 5A. In the area B . . . C, considerable evaporation of water from the web W takes place, which corresponds to the lowering of temperature illustrated in FIG. 5A in a corresponding area. In the area of effect C . . . D of the steam box 30, intensive condensation of water into the web W takes place, which is again followed by evaporation of water from the web W.

As is shown in FIG. 5B, after the point C, the condensation of water steam is maximally of an order of 1 g/m$^2$ into the bottom face of the paper, at least locally. In this way, it is possible to correct even large defects in the moisture profile in the transverse direction, and, at the same time, strains that have already been formed in the paper and in particular in its face are relaxed by means of moisture and heat as well as by means of a temperature gradient ($\Delta T_2$).

In the following, the patent claims will be given, and the various details of the invention may show variation within the scope of the inventive idea defined in said claims and differ from what has been stated above for the sake of example only.

What is claimed is:

1. A method for reducing the tendency of paper to curl in a drying section of a paper machine, comprising drying a paper web having opposed bottom and top sides by pressing the bottom side of the web against heated faces of a plurality of drying cylinders in the drying section of a paper machine, after the bottom side of the web separates from the heated face of a drying cylinder, raising the temperature of the bottom side of the web by applying a sufficient amount of steam onto the bottom side of the web to control the moisture gradient in the thickness direction of the paper web between the paper web sides in a steam treatment onto the entire width of the paper web in the drying section such that tensions that have been formed or that tend to be formed in the fiber mesh are relaxed by means of heat and moisture from the steam in the area of their formation or thereafter, said steam treatment being applied to an open face of the bottom side of the paper web as it runs on a wire in a suction sector of a suction roll or cylinder in said drying section and in an area of said drying section where the dry solids content of the paper web is from about 70 to about 98 percent, and promoting the penetration of said steam treatment into the paper web in a direction of the thickness of the paper web by means of suction present on said suction sector, to thereby control curling of the web.

2. The method of claim 1, further comprising applying said steam treatment at an end of the drying section.

3. The method of claim 1, further comprising applying said steam treatment in an area of said drying section where the dry solids content of the paper web is from about 80 to about 95 percent.

4. The method of claim 1, further comprising providing said drying section with groups of drying cylinders with single-wire draw, arranging said drying cylinders in an upper row, and arranging said suction roll or cylinder in a lower row, such that paper broke can be removed directly through open intermediate spaces located underneath said drying cylinders.

5. The method of claim 1, further comprising blowing air into spaces defined between the wire and said suction roll or cylinder.

6. A drying section of a paper machine, comprising at least one drying section group comprising a plurality of drying cylinders for drying a paper web having opposed bottom and top sides, said drying cylinders each having a heated surface, a drying wire running in a meandering fashion over said drying cylinders, said drying wire pressing the bottom side of the paper web against said heated surfaces of said drying cylinders, at least one steam box arranged in said drying group and comprising a counter-face which, together with a free face of the paper web, defines a contact-free steam-treatment gap in said drying group, said steam box extending substantially across an entire transverse width of the paper web, said steam box being positioned in a location after the bottom side of the web has separated from one of said heated surfaces of said drying cylinders and applying steam onto the bottom side of the web to raise the temperature of the bottom side of the web and control a moisture gradient in a direction of thickness of the paper web between the paper web sides substantially across an entire width of the paper web such that tensions that have been formed or that tend to be formed in the fiber mesh of the paper web are relaxed by means of heat and moisture in the area of their formation or substantially immediately thereafter, and said steam box applying steam to the paper web during the run of the paper web on a wire through the drying section the tendency of the paper web to curl is prevented in the run of the paper web through the drying section.

7. The drying section of claim 6, wherein said steam box further comprises regulating means, said regulating means controlling the quantity of steam supplied by the steam box across the transverse width of the paper web.

8. The drying section of claim 7, wherein said steam box is arranged in an area of said drying section where the dry solids content of the paper web is from about 80 to about 95 percent, by weight.

9. The drying section of claim 6, wherein said drying group further comprises a plurality of wire guide rolls and/or leading cylinders over which the paper web runs, at least one of said wire guide rolls or leading cylinders being a suction-leading cylinder provided with negative pressure, said steam box being placed in an area of said drying section having a single-wire draw on a suction zone of said suction-leading cylinder, such that the negative pressure prevailing in interior spaces of said suction-leading cylinder supports the paper web and promotes the action of the steam on the paper.

10. The drying section of claim 9 which comprises at least two drying section groups, at least one guide roll located in a gap between said drying group sections for guiding the paper web, said steam box being fitted opposite said guide roll.

11. The drying section of claim 9, wherein said drying section group has a single-wire draw in which steam is applied to the paper web running on the wire, said drying cylinders being arranged in an upper row and said wire guide rolls and/or leading cylinders being arranged in a lower row below said drying cylinders.

12. The drying section of claim 11, wherein said drying section groups comprise a plurality of additional steam boxes fitted in connection with additional ones of said leading cylinders and/or said wire guide rolls.

13. The drying section of claim 9, wherein said suction-leading cylinder has an interior portion and an outer perforated and grooved mantle, whereby suction in the interior of said suction-leading cylinder is spread onto a circumference of said suction-leading cylinder to thereby promote penetration of steam into the paper web.

14. The drying section of claim 9, further comprising blow boxes for blowing air into spaces defined between said drying wire and said leading cylinders.

15. The drying section of claim 9, further comprising at least one inverted drying section group in which drying cylinders are arranged in a lower row and wire guide rolls and/or leading cylinders are arranged in a upper row above said drying cylinders, said at least one inverted drying section group being arranged adjacent to said at least one drying section group.

16. The drying section of claim 15, wherein the web is transferred from a wire in said at least one drying section group to a wire in said at least one inverted drying section group as a closed draw.

17. The drying section of claim 6, wherein said steam box is arranged in an area of said drying section where the dry solids content of the paper web is from about 70 to about 98 percent, by weight.

18. A method for reducing the tendency of paper to curl in a drying section of a paper machine, comprising drying a paper web having opposed top and bottom sides by pressing the bottom side of the web against heated faces of a plurality of drying cylinders in the drying section of a paper machine, applying a sufficient amount of steam onto the bottom side of the web to control the moisture gradient in the thickness direction of the paper web between the paper web sides in a steam treatment onto the entire width of the paper web in the drying section such that tensions that have been formed or that tend to be formed in the fiber mesh are relaxed by means of heat and moisture from the steam in the area of their formation or thereafter, arranging said drying cylinders in an upper row and a lower row, arranging suction rolls or cylinders in gaps between said drying cylinders in said upper row and said lower row, applying said steam treatment to a free draw of the paper web located between said upper row and said lower row of said drying cylinders, and applying steam onto at least one side of the paper web, to thereby control curling of the web.

19. The method of claim 18, further comprising applying said steam treatment in an area of said drying section where the dry solids content of the paper web is from about 70 to about 98 percent.

20. The method of claim 18, further comprising applying said steam treatment in an area of said drying section where the dry solids content of the paper web is from about 80 to about 95 percent.

21. The method of claim 18, further comprising applying said steam treatment at an end of the drying section.

22. The method of claim 18, further comprising carrying the web on a wire around said drying cylinders and said suction rolls or cylinders such that the wire runs in a meandering fashion over said drying cylinders and said suction rolls or cylinders and blowing air into spaces defined between the wire and said suction rolls or cylinders.

23. The method of claim 18, further comprising arranging a first steam box to apply steam onto a first side of the web in the free draw and arranging a second steam box to apply steam onto an opposite side of the web in the free draw.

24. A method for reducing the tendency of paper to curl in a drying section of a paper machine, comprising drying a paper web having opposed top and bottom sides by pressing the bottom side of the web against heated faces of a plurality of drying cylinders in the drying section of a paper machine, after the bottom side of the web separates from the heated face of a drying cylinder, raising the temperature of the bottom side of the web by applying a sufficient amount of steam onto the bottom side of the web to control the moisture gradient in the thickness direction of the paper web between the paper web sides in a steam treatment onto the entire width of the paper web in the drying section such that tensions that have been formed or that tend to be formed in the fiber mesh are relaxed by means of heat and moisture from the steam in the area of their formation or thereafter, said steam treatment being applied to an open face of the bottom side of the paper web as it runs on a wire in a suction sector of a suction roll or cylinder located at an end of said drying section, and promoting the penetration of said steam treatment into the paper web in a direction of the thickness of the paper web by means of suction present on said suction sector, to thereby control curling of the web.

25. A method for reducing the tendency of paper to curl in a drying section of a paper machine, comprising.

drying a paper web having opposed top and bottom sides by pressing the bottom side of the web against heated faces of a plurality of drying cylinders in the drying section of a paper machine, after the bottom side of the web separates from the heated face of a drying cylinder and the temperature of the bottom side decreases to a temperature below the temperature of the top side of the web, raising the temperature of the bottom side of the web to a temperature above the temperature of the top side of the web by applying steam onto the bottom side of the web to thereby control the moisture gradient in the thickness direction of the paper web between the paper web sides such that tensions that have been formed or that tend to be formed in the fiber mesh are relaxed by means of heat and moisture from the steam in the area of their formation or thereafter, and said steam treatment being applied to an open face of the bottom side of the paper web as it runs on a wire in said drying section.

* * * * *